US011078895B2

(12) United States Patent
Eggebrecht

(10) Patent No.: US 11,078,895 B2
(45) Date of Patent: Aug. 3, 2021

(54) COMPRESSOR ASSEMBLY FOR A COMPRESSED-AIR FEED OF A COMPRESSED-AIR SUPPLY SYSTEM

(71) Applicant: Wabco GmbH, Hannover (DE)

(72) Inventor: Detlev Eggebrecht, Hannover (DE)

(73) Assignee: ZF CV SYSTEMS HANNOVER GMBH, Hannover (DE)

( * ) Notice: Subject to any disclaimer, the term of this patent is extended or adjusted under 35 U.S.C. 154(b) by 13 days.

(21) Appl. No.: 16/496,970

(22) PCT Filed: Apr. 9, 2018

(86) PCT No.: PCT/EP2018/058950
§ 371 (c)(1),
(2) Date: Sep. 24, 2019

(87) PCT Pub. No.: WO2018/197186
PCT Pub. Date: Nov. 1, 2018

(65) Prior Publication Data

US 2020/0386217 A1 Dec. 10, 2020

(30) Foreign Application Priority Data

Apr. 28, 2017 (DE) ..... 10 2017 004 086.9

(51) Int. Cl.
*F04B 39/00* (2006.01)
*F04B 27/053* (2006.01)
*F04B 39/12* (2006.01)

(52) U.S. Cl.
CPC ..... *F04B 39/0022* (2013.01); *F04B 39/0027* (2013.01); *F04B 27/053* (2013.01); *F04B 39/121* (2013.01)

(58) Field of Classification Search
None
See application file for complete search history.

(56) References Cited

U.S. PATENT DOCUMENTS 5,556,264 A * 9/1996 Simonette ..... B08B 3/026 248/129
5,584,672 A * 12/1996 Simonette ..... B08B 3/026 248/129
8,443,713 B2 * 5/2013 Ogawa ..... F04B 53/147 92/138

(Continued)

FOREIGN PATENT DOCUMENTS

CH 87818 A 5/1921
DE 2424562 A1 12/1975

(Continued)

*Primary Examiner* — Peter J Bertheaud
*Assistant Examiner* — Geoffrey S Lee
(74) *Attorney, Agent, or Firm* — Leydig, Voit & Mayer, Ltd.

(57) ABSTRACT

A compressor assembly includes a compressor having a cylinder and a connecting rod in a connecting rod plane. The connecting rod includes a compressor piston and a connecting rod bearing. The compressor assembly includes a drive having an axis of rotation, a drive shaft, and a housing. The drive shaft is mounted in a drive shaft bearing and has a connecting rod side end and a connecting rod remote end. The drive shaft has a connecting-rod receiving portion which is arranged eccentrically to the axis of rotation of the drive at the connecting rod side end.

20 Claims, 6 Drawing Sheets

(56) References Cited

U.S. PATENT DOCUMENTS

| | | | | |
|---|---|---|---|---|
| 8,608,455 | B2 * | 12/2013 | Ishida | F01B 1/062 417/273 |
| 8,932,029 | B2 * | 1/2015 | Komatsu | F04B 27/053 417/273 |
| 10,215,166 | B2 * | 2/2019 | Bassine | F04B 35/01 |
| 10,253,630 | B2 * | 4/2019 | Shimazu | F02B 75/32 |
| 2005/0238513 | A1 | 10/2005 | Mueller | |
| 2007/0096588 | A1 * | 5/2007 | Kirchner | B65G 39/09 310/261.1 |
| 2014/0119961 | A1 | 5/2014 | Gonzalez et al. | |
| 2016/0001624 | A1 * | 1/2016 | Meissner | F04B 17/03 417/53 |
| 2018/0187664 | A1 * | 7/2018 | Bassine | F04B 27/0657 |

FOREIGN PATENT DOCUMENTS

| | | | |
|---|---|---|---|
| DE | 102004020104 | A1 | 11/2005 |
| DE | 102010062160 | A1 | 5/2012 |
| DE | 102013100015 | A1 | 7/2014 |
| DE | 102013003513 | A1 | 9/2014 |
| DE | 102005009445 | B4 | 12/2015 |
| DE | 102016001576 | A1 | 8/2017 |

* cited by examiner

COMPRESSOR ASSEMBLY FOR A COMPRESSED-AIR FEED OF A COMPRESSED-AIR SUPPLY SYSTEM

CROSS REFERENCE TO RELATED APPLICATIONS

This application is a U.S. National Phase Application under 35 U.S.C. § 371 of International Application No. PCT/EP2018/058950, filed on Apr. 9, 2018, and claims benefit to German Patent Application No. DE 10 2017 004 086.9, filed on Apr. 28, 2017. The International Application was published in German on Nov. 1, 2018 as WO 2018/197186 under PCT Article 21(2).

FIELD

The invention relates to a compressor assembly for a compressed-air feed of a compressed-air supply system, for operating a pneumatic system, having: a compressor having at least one cylinder and at least one connecting rod in a connecting-rod plane. The invention also relates to a compressed-air supply system for operating a pneumatic system.

BACKGROUND

Compressors, in particular compressors in compressed-air supply systems in vehicles, are generally known. In general, a long service life, robustness, efficiency and a low-noise and low-vibration operation constitute important aspects in the improvement of such a compressor.

Compressors which provide for the adjustability of the crank drive on the motor shaft for the purpose of reducing the bearing play and thus the noise generation are known. DE 10 2005 009 445 B4 thus describes a compressor unit for generating compressed air in a vehicle, having a piston compressor and a motor for driving the piston compressor, wherein its piston is driven via a connecting rod/crank drive assembly by the motor via a motor shaft, characterized in that, during assembly of the compressor unit, the crank drive is adjustable on the motor shaft in the longitudinal direction of the motor shaft.

A compressor assembly from DE 10 2004 020 104 A1 shows a double piston for a compressor, having an elongate piston support which has a piston at each end, and having a connecting rod which extends approximately parallel to the piston support and which is rotatably mounted by means of a drive shaft bearing on a pin of the piston support and can be mounted at a distance therefrom by means of a connecting-rod bearing on an eccentric of a drive device; drive shaft bearing and connecting-rod bearing are thus situated approximately in the same axial direction at a distance above one another. In a central region which extends between the two pistons, the piston support contains an interspace which is dimensioned for the freely movable reception of the connecting rod and in which the connecting rod is received in a freely movable manner.

Also known are methods for direct mass balancing in piston machines. DE 2424562 A1 describes a method of direct mass balancing. The direct mass balancing is characterized in that the piston has its center of gravity in its axis of rotation about the piston pin, a balance weight is mounted on the connecting rod and the system of all oscillating parts is balanced in such a way that the common center of gravity is situated in the axis of rotation of the crankshaft.

SUMMARY

In an embodiment, the present invention provides a compressor assembly for a compressed air feed of a compressed air supply system, for operating a pneumatic system. The compressor assembly includes a compressor having a cylinder and a connecting rod in a connecting rod plane. The connecting rod includes a compressor piston and a connecting rod bearing. The compressor assembly further includes a drive having an axis of rotation, a drive shaft, and a housing. The drive shaft is mounted in a drive shaft bearing and has a connecting rod side end and a connecting rod remote end. The drive shaft has a connecting-rod receiving portion which is arranged eccentrically to the axis of rotation of the drive at the connecting rod side end. The drive shaft bearing and the connecting rod bearing are arranged such that the drive shaft bearing is situated at least partially within the connecting rod bearing in a radial direction.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Compressor assemblies having a compressor including at least one cylinder and at least one connecting rod are still in need of improvement, in particular with regard to a low-noise and low-vibration operation and with regard to the durability of the compressor.

It is therefore desirable to improve the function of a compressor assembly, in particular the mechanical coupling of drive and compressor, in particular with respect to these aspects, namely with respect to a low-noise and low-vibration operation.

Embodiments of the invention specify, in an improved manner, an assembly, in particular a compressor assembly, a compressed-air supply system and a vehicle, which particularly address the aforementioned problems.

Embodiments of the invention provide compressor assemblies for a compressed-air feed of a compressed-air supply system, for operating a pneumatic system, having: a compressor having at least one cylinder and at least one connecting rod in a connecting-rod plane, wherein the at least one connecting rod further has a compressor piston and at least one connecting-rod bearing, a drive having an axis of rotation and a drive shaft, and also a housing, wherein the drive shaft is mounted in at least one drive shaft bearing and has a connecting-rod-side end and a connecting-rod-remote end, and the drive shaft has a connecting-rod-receiving portion which is arranged eccentrically to the axis of rotation of the drive at the connecting-rod-side end.

According to the invention, there is provision that the at least one drive shaft bearing and the at least one connecting-rod bearing are arranged in such a way that the at least one drive shaft bearing is situated at least partially within the at least one connecting-rod bearing in the radial direction.

Figure 2C:
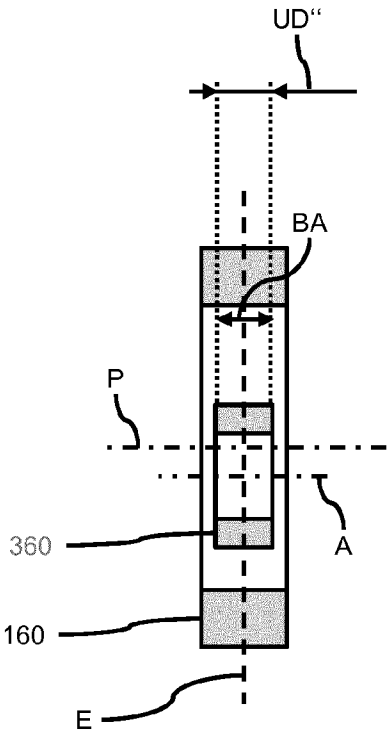
FIGS. 2A-2C show different arrangements of drive shaft bearing and connecting-rod bearing according to embodiments of the invention.
Figure 2B:
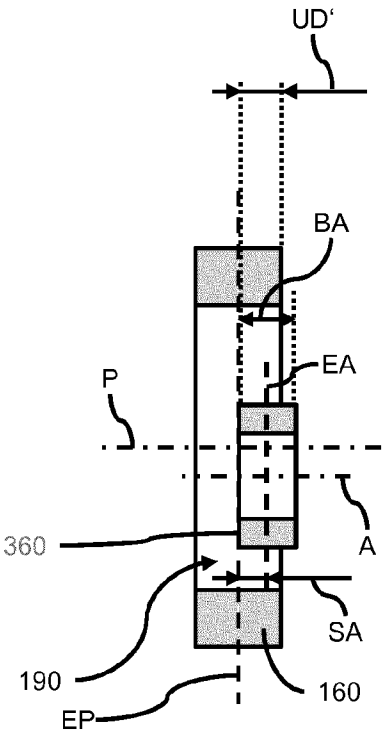
Figure 2A:
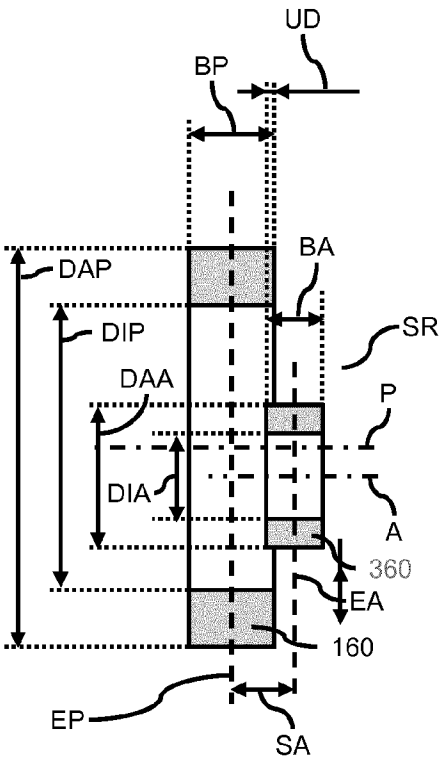

What is meant by this, in particular, is that, as viewed in a projection plane perpendicular to the axis of rotation, the outside diameter of the drive shaft bearing is situated completely within the inside diameter of the connecting-rod bearing; this is illustrated by way of example in FIGS. 2A-2C. Within the context of the development, this can mean in particular that the drive shaft bearing is displaced in the axial direction along the axis of rotation in the direction of the connecting-rod bearing or of the drive, that is to say laterally, in such a way that it is situated with respect to its axial extent completely or partially within the connecting-rod bearing interior. In particular, this can advantageously also mean that the drive shaft bearing is arranged displaced along the axis of rotation of the drive in the direction of the connecting-rod bearing in such a way that it projects by a certain distance, referred to as overlap, into a connecting-rod bearing interior of the connecting-rod bearing. The case that the drive shaft bearing is situated completely in the connecting-rod bearing interior is referred to as complete overlap.

Particularly with the simultaneous arrangement of the drive shaft bearing—as viewed in the radial direction—within the connecting-rod bearing, this leads to a particularly advantageous design.

In particular, embodiments of the invention suppress negative mechanical effects, which are caused in particular by bending moments, such as vibrations, structure-borne noise generation and air-borne noise generation both by means of the axially overlapping bearing arrangement and by means of the improved introduction of the connecting-rod forces into the housing. This is achieved in particular by the axial arrangement of the first bearing or A bearing within the connection-rod bearing and the frame-fixed fastening of the inner ring of the A bearing on the frame-fixed journal. Specifically, tilting moments on the drive shaft bearings, in particular on a first bearing or A bearing, and axial forces acting on the drive shaft are reduced or avoided in particular in an advantageous manner in this way. A low-noise and low-vibration operation is of large importance particularly for vehicles in the passenger car sector since here, by contrast to applications in the truck sector, the acoustic requirements are higher or more sensitive.

Embodiments of the invention provide an, in particular, low-vibration and low-noise compressor assembly that functions in an improved manner. Furthermore, a reduction of forces and/or moments, and in particular a reduction of the dynamic loads and vibrations associated with the forces and/or moments, lead to a more gentle mode of operation which have a positive effect on efficiency and durability of the compressor assembly. In the present case, these loads particularly include tilting moments which act on the connecting-rod bearing and which, in the case of a conventional drive shaft mounting, occur as a result of shaft bending. The reduction or the avoidance of tilting moments by means of a mounting according to the invention can lead to better durability of the connecting rod; as a result, the connecting rod can be designed to be smaller and thus lighter in particular in a constructive optimization.

The in particular bending-moment-free mounting of the drive shaft according to the context of the invention likewise reduces radial forces acting on the compressor piston and in particular on the sealing sleeve. This results in an advantageous manner in a longer service life of the compressor components and drive components, in particular connecting-rod bearings, drive shaft bearings, compressor pistons and/or sleeve.

Within the scope of a particularly preferred development, in the compressor assembly the drive shaft is mounted in the connecting-rod-side drive shaft bearing, which is arranged at a connecting-rod-side end of the drive shaft in a bearing plane, as first bearing on a first bearing-receiving portion arranged coaxially to the axis of rotation.

The development is based on the consideration that a distance in the axial direction between the bearing plane of the first bearing, or A bearing, and connecting-rod plane leads to a bending moment which results in particular in a deformation of the drive shaft. Such a deformation can lead, in a rotating drive shaft, to possibly disadvantageous dynamic load states and to noise and vibration generation. Such noise and vibration generation can be still further intensified by bearing play which possibly increases over the operating time. Deformations of the drive shaft can particularly be attributed to connecting-rod forces which arise during a compression of the air by the movement of the compressor piston in the cylinder and are channeled into the drive shaft via the connecting-rod bearing and/or the first bearing, or A bearing. Here, the bending moment is proportional to the connecting-rod forces and the distance in the axial direction between the bearing plane and the connecting-rod plane.

The development has recognized that the bending moment acting on the drive shaft is reduced with a reduction of the distance in the axial direction between the bearing plane of the first bearing, or A bearing, and the connecting-rod plane of the connecting rod. A reduction can be achieved in particular if the first bearing, or A bearing, is arranged within the connecting-rod bearing in the radial direction. In particular, a bending moment caused by connecting-rod forces and acting on the drive shaft is completely avoided with a complete avoidance of the distance in the axial direction between the bearing plane of the first bearing, or A bearing, and the connecting-rod plane of the connecting-rod bearing.

In particular, there is provision that the drive shaft is mounted in the connecting-rod-remote drive shaft bearing, which is arranged at a connecting-rod-remote end of the drive shaft, as second bearing on a second bearing-receiving portion arranged coaxially to the axis of rotation at the connecting-rod-remote end.

Furthermore, there is provision in a preferred development that the bearings are arranged within and/or on the housing. The housing can comprise and house the compressor assembly and/or the drive and/or further components, and particularly advantageously can be of modular design, that is to say that it can be designed in particular individually in each case for compressor assembly and drive, but can be assembled.

Preferably, in the compressor assembly:

the first bearing-receiving portion for receiving the first bearing is designed as a cylindrical cavity, and/or the first bearing is further fastened to a journal which is connected to the housing in a frame-fixed manner and which is arranged practically coaxially to the axis of rotation, wherein the first bearing is seated in the cylindrical cavity between the first bearing-receiving portion and the journal.

Furthermore, the development is based on the consideration that a reversal of the fastening arrangement of the first bearing, or A bearing, namely the positionally fixed or frame-fixed fastening of the inner ring and a rotatable mounting of the outer ring, particularly advantageously allows the connecting-rod forces to be channeled off into the housing. This is particularly the case because the frame-fixed fastening of the first bearing, or A bearing, is possible by means of a frame-fixed journal at a small axial distance from the wall of the housing. The small axial distance makes possible an improved take-up of the connecting-rod forces, in particular without bending moments caused by connecting-rod forces and particularly preferably without deformation of the drive shaft or of the journal.

In particular, there is provision that the first bearing is seated fixedly on the journal and is seated firmly in the first bearing-receiving portion and connects the journal and the first bearing-receiving portion such that they can be rotated relative to one another. In concrete terms, this means that the bearing inner ring of the first bearing is fastened on the journal in a positionally fixed manner, for example by means of a suitable form-fitting, force-fitting or integrally bonded fastening method. Furthermore, the bearing outer ring of the first bearing is connected fixedly to the bearing-receiving portion of the drive shaft. This makes possible a rotational relative movement between the frame-fixed journal and the drive shaft about the axis of rotation.

There is advantageously provision that the compressor has a plurality of connecting rods, in particular a first connecting rod and a second connecting rod. In concrete terms, this can comprise gas, in particular air, being compressed in two or more compression chambers. In this case, a two-stage compressor is realized by the arrangement of two cylinders, wherein the cylinders each have a compressor piston and a connecting rod. They are driven in particular by a drive shaft and are preferably arranged in such a way that the overall system is situated in a practically balanced state. A two-stage compressor leads in particular to the advantages of higher achievable efficiencies and compression pressures.

In particular there is provision that the first connecting rod and the second connecting rod are arranged in such a way that the first connecting rod is arranged at a first bearing distance and the second connecting rod is arranged at a second bearing distance in the axial direction, i.e. in the direction of the axis of rotation, from the bearing plane. In concrete terms, this means that, depending on the design requirement, the first and the second bearing distance can be chosen in such a way that in particular deformations of the drive shaft and loads on connecting rod and bearing can be minimized as far as possible. Particularly for the case that one connecting rod takes up greater forces than the other, bending moments acting on the drive shaft can be minimized by virtue of the fact that the bearing distance from the connecting rod taking up the greater forces is reduced. Furthermore, the setting of the bearing distance can be used in an advantageous manner to produce a shaft bending, in particular to compensate for a deformation of the journal. This is illustrated by way of example in the drawing in FIG. 3 and further explained by way of example within the scope of a preferred embodiment in conjunction with FIG. 3.

Within the scope of a particularly preferred development, there is provision that the first connecting rod and the second connecting rod are arranged in such a way that the bearing plane is situated in the axial direction centrally between a first connecting-rod plane (already here for illustration: designated by P1 in the drawing) and a second connecting-rod plane (already here for illustration: designated by P2 in the drawing). In concrete terms, this means that the first and the second connecting-rod plane are arranged at an axial distance which is equal in magnitude, but in the opposite direction, from the bearing plane. Although in this development neither of the two connecting-rod planes is situated in the bearing plane and bending moments acting on the drive shaft thus occur, the axially central arrangement of the first bearing, or A bearing, between the two connecting rods represents a compromise for minimizing the bending moments arising as a result of connecting-rod forces.

In particular, there is provision that the compressor has a first connecting rod which is arranged in the bearing plane of the first bearing, with the bearing distance between connecting-rod plane and bearing plane being practically equal to zero. In concrete terms, this means that, by virtue of the arrangement of first connecting rod and first bearing, or A bearing, without axial distance, a practically bending-moment-free take-up of connecting-rod forces is achieved with a bearing arrangement according to the invention.

This development comes particularly into question for single-stage compressors having a connecting rod and a cylinder. However, within the scope of this bending-moment-free, simple connecting-rod arrangement, as described further below, there can also be realized a two-stage compressor within a cylinder having a compressor piston which can be charged with pressure on both sides.

In particular, there is provision that the compressor has a first connecting rod which is arranged at an axial bearing distance from the first bearing. In concrete terms, this means that the connecting-rod forces acting on the drive shaft lead to a bending moment which, depending on the structural design of the drive shaft, can lead in particular to a deformation. This deformation, in particular a bending of the drive shaft, can advantageously be used for example to compensate for a deformation of the journal. This is illustrated by way of example in the drawing in FIG. 3 and further explained by way of example within the scope of a preferred embodiment in conjunction with FIG. 3.

Within the scope of a particularly preferred development, there is provision that the first connecting rod and the compressor piston are rigidly connected to one another, with in particular the compressor being designed a wobble piston compressor. This means in concrete terms that connecting rod and compressor piston are formed substantially in one piece. This results in the advantage that fewer moving parts for coupling drive and compressor piston have to be used and, where appropriate, also no guide elements are required for the piston in order to take up lateral forces introduced by the connecting rod. Any gaps between cylinder and compressor piston that occur as a result of the wobble kinematics are sealed in such an embodiment by means of suitable seals, in particular piston sleeve seals.

There is advantageously provision that the compressor is designed as a single-stage compressor. In concrete terms, this means that the gas, in particular the air, is compressed in a compression chamber. The compression chamber is formed by the interior of the cylinder and the side of the compressor piston that is situated opposite to the connecting rod.

In particular, there is provision that the compressor is designed as a multistage compressor, in particular a two-stage compressor. In concrete terms, this means that the gas, in particular the air, is compressed in two or more compression chambers. Such a multistage compressor be realized by the arrangement of a plurality of pistons, in particular two pistons, wherein the pistons each have a compressor piston and a connecting rod. They are driven in particular by a drive shaft and are preferably arranged in such a way that the overall system is situated in a practically balanced state.

In the case of a two-stage compressor, the gas can be compressed for example in two compression chambers which are each formed by a cylinder and a compressor piston which can be charged with pressure on both sides. Here, the side of the compressor piston that is situated opposite to the connecting rod, together with the interior of the cylinder that is situated on this side of the compressor piston, forms the first compression chamber. Furthermore, the side facing the connecting rod, together with the interior of the cylinder that is situated on that side of the compressor piston, forms the second compression chamber.

There is advantageously provision that the connecting-rod bearing is formed as a rolling bearing, in particular a ball bearing, needle bearing, cylinder roller bearing, barrel bearing or similar rolling bearing.

In concrete terms, this means that a bearing form is chosen on the basis of the design requirements. Needle bearings and cylinder roller bearings and in general rolling bearings having cylindrical rolling bodies have a generally high radial load-bearing capacity on account of the linear contact with the running surface. A needle bearing is additionally relatively compact on account of the small rolling body diameters, and thus advantageously further reduces the installation space of the drive. Ball bearings have, by virtue of the osculation in the rolling contacts, a relatively high axial and radial load-bearing capacity. Furthermore, barrel bearings allow a certain swinging movement between inner and outer ring by virtue of the spherical design of the rolling bodies and a hollow-spherical outer ring raceway. Insensitivity to skewing and alignment errors of the drive shaft with respect to the housing is thus achieved.

There is advantageously provision that the first bearing and/or the second bearing are/is formed as a sliding bearing. In concrete terms, this can be achieved by a lubricated or lubrication-free sliding mounting. This advantageously leads to a low-maintenance, particularly preferably maintenance-free, design of the rotatable connection since, apart from the relative movement between shaft and bearing, it has no moving parts, in particular no rolling bodies.

In particular, there is provision that the first bearing and/or the second bearing are/is fastened in a force-fitting manner, in particular by means of a tolerance ring. In concrete terms, the tolerance ring can be formed by a metal spring ring, or a ring which consists of rubber or plastic and has a suitable cross section, or a further suitable, compressible connection element. Furthermore, the first bearing, or A bearing, and/or the second bearing, or B bearing, can, alternatively and/or additionally, also be fixed in another way, for example in a form-fitting manner by means of a securing ring arranged in the axial direction or in a force-fitting or frictional manner by means of thermal shrinking. The fastening by means of a fastening element, such as, for example, a tolerance ring, can refer both to the inner side of the inner ring and to the outer side of the outer ring of the respective bearing. Therefore, it would be possible for example for the first bearing to have both a tolerance ring arranged between the cavity and the outer ring of the first bearing and between a tolerance ring arranged between the journal and the inner ring.

Embodiments of the invention further provide compressed-air supply systems for operating a pneumatic system. Such compressed-air supply systems have an aforementioned compressor assembly, an air dryer and a valve arrangement. Embodiments of the invention further include vehicles having a compressed-air supply system and a pneumatic system, wherein the compressed-air supply system has an aforementioned compressor assembly. A compressor assembly according to the invention is particularly advantageous in passenger cars, since high acoustic requirements prevail in the passenger car sector and a low-noise and low-vibration operation of the compressor assembly has high importance or is advantageous.

Embodiments of the invention are now described below on the basis of the drawing. This is not necessarily intended to show the embodiments to scale, but the drawing rather takes a schematized and/or slightly distorted form wherever this is useful for explanatory purposes. For additions, to the teachings that are directly evident from the drawing, reference is made to the relevant prior art. At the same time, it must be taken into account that a wide variety of modifications and changes relating to the form and the detail of an embodiment can be made without departing from the invention. The features of the invention that are disclosed in the description, in the drawing and in the claims may be essential to the development of the invention both individually and in any desired combination. Moreover, the scope of the invention covers all combinations of at least two features disclosed in the description, the drawing and/or the claims. The invention is not limited to the exact form or the detail of the preferred embodiments shown and described below or limited to subject matter that would be restricted in comparison with the subject matter claimed in the claims. Where dimensional ranges are specified, values lying within the stated limits are also intended to be disclosed as limit values and are able to be used and claimed as desired. For the sake of simplicity, the same reference signs are used below for identical or similar parts or parts having an identical or similar function.

Figure 1:
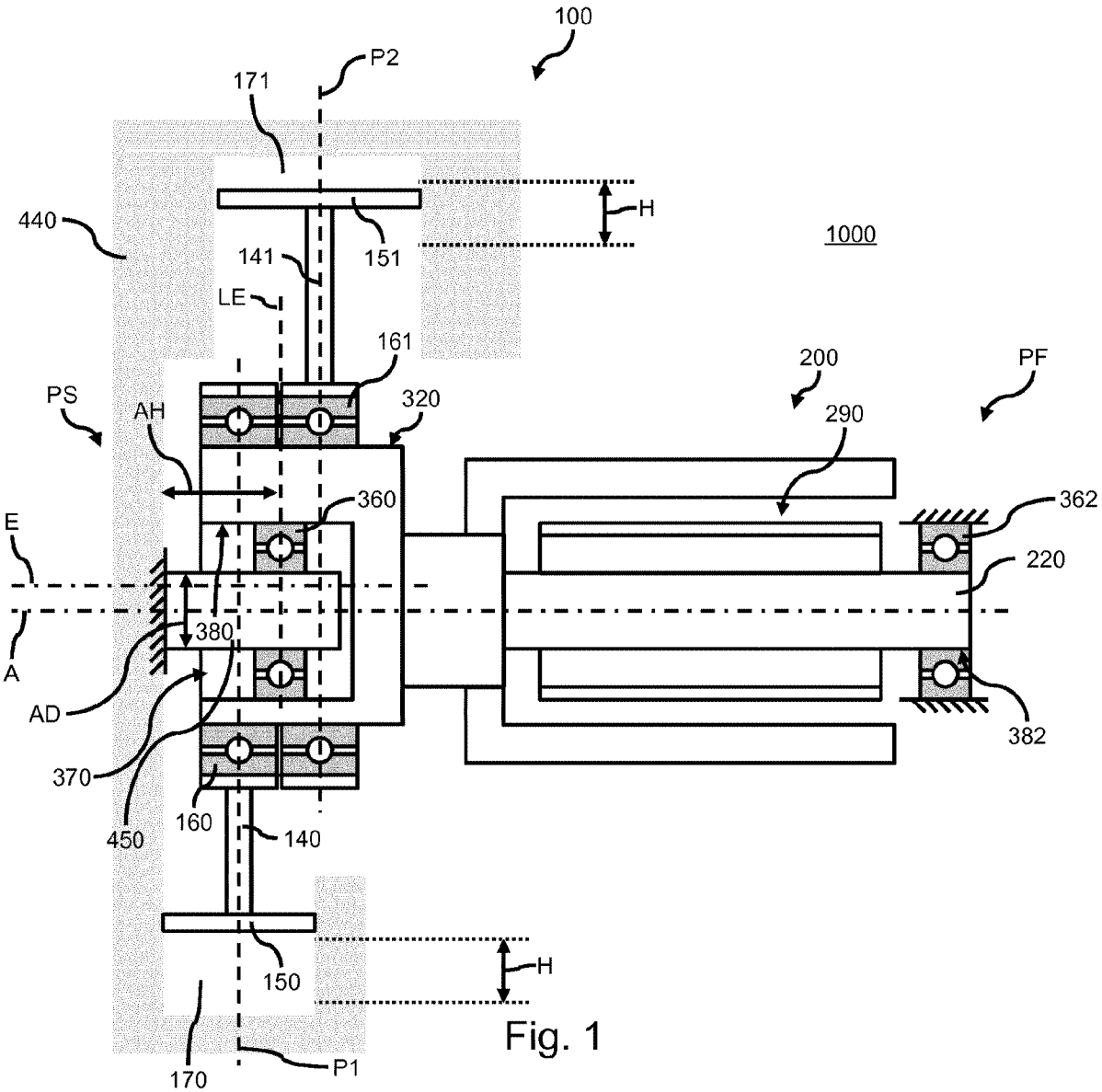
FIG. 1 shows a compressor assembly according to an embodiment of the invention.

FIG. 1 shows a compressor assembly having a compressor 100 according to a particularly preferred embodiment of the invention. In a first cylinder 170, a first connecting rod 140 having a first compressor piston 150 is moved upward and downward in an oscillating manner and practically along the axis of symmetry of the first cylinder 170 for the purpose of compressing air. In the present case, the first compressor piston 150 is illustrated close to the top dead center, i.e. at the upper end of the stroke travel H. Given the fact that the embodiment shown here concerns a wobble piston compressor, that is to say that the first connecting rod 140 and the first compressor piston 150 are rigidly connected, the oscillating movement is indeed predominantly but not completely translational. During the upward and downward movement, the first connecting rod 140 and the first compressor piston 150 therefore execute a wobbling movement corresponding to the kinematics.

In a second cylinder 171, in an analogous manner to the first cylinder 170, a second connecting rod 141 having a second compressor piston 151 is moved upward and downward in an oscillating manner and practically along the axis of symmetry of the second cylinder 171 for the purpose of compressing air.

However, an embodiment according to the invention would also be conceivable in which—as widely customary in piston compressors—the first compressor piston 150 is articulately connected to the first connecting rod 140 or the second compressor piston 151 is articulately connected to the second connecting rod 141, in particular in each case by means of a bearing arrangement.

In addition to the two-stage compressor shown, single-stage compressors are also possible according to the invention. It is also possible in a further development for a multistage compressor to be formed by a single-piston compressor which forms a plurality of compression chambers by means of correspondingly stepped pistons and cylinders or by means of a piston which can be charged with pressure on a plurality of sides.

In the present development, the drive shaft 220 is mounted in a housing 440 by means of a first, connecting-rod-side drive shaft bearing, or A bearing 360, and a second, connecting-rod-remote drive shaft bearing, or B bearing 362. Here, both the A bearing 360 and the B bearing 362 can be fastened by means of a tolerance ring 164, which is not shown in further detail here. This fastening, which serves in particular for a fixed bearing seat, can refer both to the inner side of the respective bearing 360, 362 and to the outer side of the respective bearing 360, 362.

Furthermore, in the present case, the two cylinders 170, 171 are arranged practically opposite with respect to the axis of rotation A. They are thus advantageously arranged in such a way that the linear inertia forces of the system of moving masses, in particular the connecting rods, compressor pistons and sleeves, cancel one another during the movement.

In the case of a single-stage, in particular single-piston compressor, this canceling function of an opposite piston can be achieved by a balance weight. Analogously, to achieve a mass balancing in the case of a cylinder or piston number greater than two, the cylinders must be arranged about the axis of rotation A in such a way that the inertia forces overall balance out.

The connecting rods 140, 141 further have, in each case on their sides opposite to the compressor piston 150, 151, a connecting-rod eye which serves for receiving a connecting-rod bearing 160, 161. The connecting-rod bearing 160, 161 serves furthermore for the rotatable connection of the connecting rod 140, 141 to a connecting-rod-receiving portion 320 of a drive shaft 220.

In the present case, the connecting-rod-receiving portion 320 is connected to the drive shaft 220 in one piece; nevertheless, it is equally possible for connecting-rod-receiving portion 320 and drive shaft 220 to be configured in two pieces and to be joined together via a corresponding form-fitting, force-fitting or integrally bonded connection.

The drive shaft 220 further has, at a connecting-rod-side end PS, in addition to the outer connecting-rod-receiving portion 320, an inner first bearing-receiving portion 380. The outer connecting-rod-receiving portion 320 has a cylindrical external shape which receives the inner ring of the connecting-rod bearings 160, 161. The inner first bearing-receiving portion 330 has a cylindrical internal shape, and serves for receiving the first bearing, or A bearing 360. Both connecting-rod bearings 160, 161 and first bearing, or A bearing 380, and second bearing, or B bearing 382, can be fastened to the drive shaft 220 in different ways. In particular, this fastening can occur in a form-fitting manner, for example by means of suitable fastening elements, in a force-fitting manner by shrinking on or by a combination of the aforementioned or further operating principles.

The A bearing 360 is furthermore connected to the housing 440 via a frame-fixed journal 450. This means that the inner ring of the A bearing 360 is fastened on the journal 450 in a positionally fixed manner, whereas the outer ring of the A bearing 360 is mounted so as to be rotatable about the axis of rotation A. The rotational movement of the drive shaft 220 is thus made possible by the reception of the outer ring of the A bearing 360 in the first bearing-receiving portion 380, together with the mounting by means of the B bearing 362 at a connecting-rod-remote end PF of the drive shaft 220. Here, the journal 450 makes it possible in a particularly advantageous manner for connecting-rod forces to be channeled as directly as possible into the wall of the housing 440 without significant bending moments arising or significant deformations occurring as a result of arising bending moments.

Actually occurring deformations of the journal 450 can be reduced to a negligible level by a corresponding dimensioning of the journal 450, in particular by increasing the journal diameter AD and/or reducing the journal lever AH.

In the present case, the first connecting-rod bearing 160 is arranged in a first connecting-rod plane P1 and the second connecting-rod bearing 161 is arranged in a second connecting-rod plane P2 with respect to the A bearing 360 in such a way that the bearing plane LE of the A bearing 360 is situated in the axial direction centrally between the connecting-rod planes P1 and P2. According to the invention, it is advantageously ensured in this way that, with consideration of all the connecting-rod forces occurring during operation in both connecting rods 140, 141, an optimally low-bending moment state, in particular bending-moment-free state, of the drive shaft 220 is achieved.

In fact, bending moments continue to occur on account of the distance between both connecting-rod planes P1 and P2; however, the central positioning of the A bearing 360 in the axial direction centrally between the connecting-rod planes P1 and P2 represents an optimum with respect to the minimization of bending moments caused by connecting-rod forces. This central position results from the assumption of connecting-rod forces in both connecting rods 140, 141 that are virtually equal in terms of magnitude. In the case of a deviation of the occurring connecting-rod forces in one of the two connecting rods 140, 141, it would be necessary to minimize the bending moments to displace the A bearing 360 and thus the bearing plane LE correspondingly axially in the direction of that connecting-rod bearing 160 or 161 at which the greater connecting-rod forces are taken up.

In order to generate an oscillating stroke movement of connecting rod 140, 141 and compressor piston 150, 151, the connecting-rod-receiving portion 320 is arranged eccentrically to the axis of rotation A of the drive shaft 220. That is to say that the axis of symmetry of the first bearing-receiving portion 380 that lies on the axis of rotation A is arranged parallel but offset to the cylinder axis of the cylindrical connecting-rod-receiving portion 320 that lies on the eccentric axis Ex of the connecting-rod bearings 160, 161.

The drive shaft 220 serves for transmitting the rotational movement generated by a drive 200 to the connecting rods 140, 141. In the present case, the drive shaft 220 is driven via an electric motor 290.

The A bearing 360 is arranged in the axial direction centrally between the connecting-rod planes P1 and P2. In this way, bending moments acting on the drive shaft 220 are substantially reduced, or avoided, since practically all the connecting-rod forces act substantially within the bearing plane LE and thus practically no or only a small lever arm for a bending moment acting on the drive shaft 220 can occur.

With reference to FIG. 2A to FIG. 2C, there is schematically shown in the present case a situation with a single connecting-rod bearing 260' and a single drive shaft bearing 260. This situation also symbolically stands for an embodiment illustrated in FIG. 1 or FIG. 3. In this respect, the connecting-rod bearing 260' of FIG. 2 stands symbolically for a connecting-rod bearing arrangement 160, 161 of FIG.

1 or FIG. 3 and the drive shaft bearing 260 of FIG. 2 stands symbolically for a drive shaft bearing arrangement 360 of FIG. 1 or FIG. 3.

FIG. 2A illustrates a development in which the connecting-rod bearing 260' and drive shaft bearing 260 partially overlap. This means that the drive shaft bearing 260 is displaced in the axial direction along the axis of rotation A in the direction of the connecting-rod bearing 260' in such a way that it is situated partially within the connecting-rod bearing interior 190. This displacement—in the present case in the direction of the drive 200 according to FIG. 1 (to the right in FIG. 2A and FIG. 2B)—is described by an axial distance SA between the axial center plane EP of the connecting-rod bearing 260' and the axial center plane EA of the drive shaft bearing 260. In an alternative modification, this displacement can also be implemented in a direction away from the drive 200 according to FIG. 1 (that would then be to the left in FIG. 2A and FIG. 2B).

The greater the axial distance SA is chosen, the larger are the bending moments which act on the drive shaft 220 and which are caused by connecting-rod forces and which are intended to be reduced or avoided.

The overlap UD here refers to that axial distance by which the drive shaft bearing 260 projects into the connecting-rod bearing interior 190. In the embodiment which can be seen in FIG. 2A, the overlap UD results from the width BP of the connecting-rod bearing 260', the width BA of the drive shaft bearing 260 and the axial distance SA.

In the development illustrated in FIG. 2A, the overlap UD is comparatively small, with in particular the drive shaft bearing 260 projecting to a lesser extent by a distance UD into the connecting-rod interior 190 that is less than half of its axial width BA. This case of a "simple" overlap UD can be expressed by the following relationship: UD<0.5*BA.

The invention can—at any rate in principle, even if not preferred—be realized in another embodiment (not shown here) when no overlap occurs. It is shown that this would be acceptable at any rate in the embodiment (not shown here) as long as the axial distance SA is sufficiently small to avoid a lever arm for bending moments acting on the drive shaft 220 and caused by connecting-rod forces. The value SA=BP+BA is considered to be a benchmark for a maximum axial distance SA.

FIG. 2B illustrates a further possible arrangement of connecting-rod bearing 260' and drive shaft bearing 260. It is essential here that the varied overlap UD', which is visible in FIG. 2B, of the embodiment of FIG. 2B is greater than the overlap UD of the development illustrated in FIG. 2A. As a result of an overlap UD' increased in this respect, the drive shaft bearing 260 projects into the connecting-rod bearing interior 190, wherein the increased overlap UD' is greater than half the axial width BA of the drive shaft bearing 260. This case of the increased and in this respect "predominant" overlap UD' can be expressed by the following relationship: 0.5*BA<UD'<BA.

It also holds for the development illustrated here that the axial distance SA is reduced by comparison with the development illustrated in FIG. 2A. This advantageously results in the fact that the lever arm for bending moments on the drive shaft 220 and caused by connecting-rod forces is also reduced according to the invention.

FIG. 2C finally shows a third possible bearing arrangement in which, in a particularly advantageous manner, the axial center plane EP of the connecting-rod bearing 260' and the axial center plane EA of the drive shaft bearing 260 coincide in a bearing plane E. This means that the axial distance SA is equal to zero and thus practically no lever arm exists for forces channeled from the connecting rod 140 into the drive shaft 220. An occurrence of bending movements is particularly advantageously avoided in this way according to the invention. The fact that the drive shaft bearing 260 is arranged in the axial direction in such a way that it is situated completely in the connecting-rod bearing interior 190 leads to a further evidently increased, namely "complete" overlap UD", that is to say: UD"=BA.

FIG. 3A-FIG. 3D show different arrangements of A bearing and connecting-rod bearing or connecting-rod bearings according to the invention.

Figures 3A, 3B, 3C, 3D:
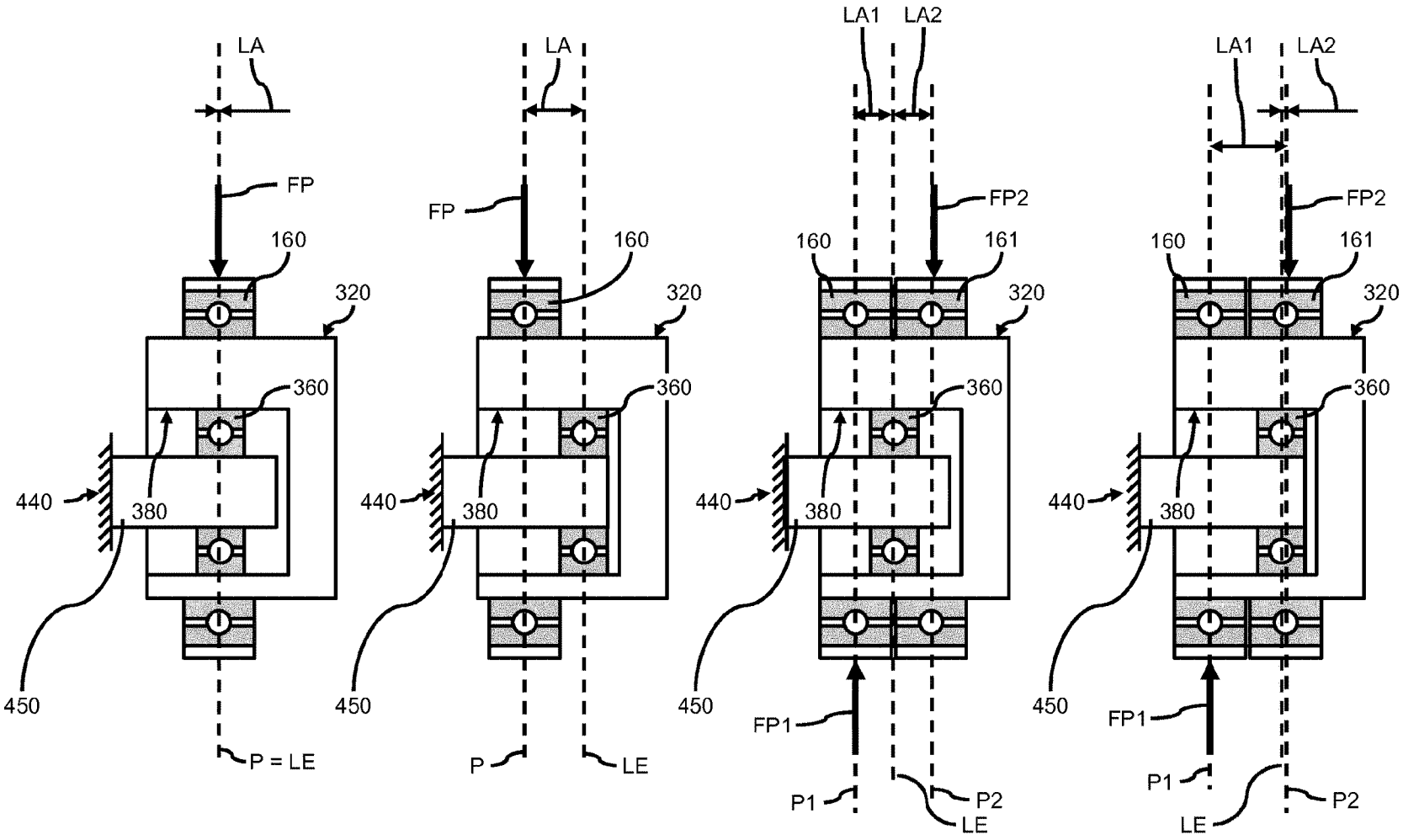
FIGS. 3A-3D show different arrangements of first bearing, or A bearing, and connecting-rod bearing according to embodiments of the invention.

FIG. 3A illustrates a bearing arrangement according to one development in which A bearing 360 and connecting-rod bearing 160 overlap practically precisely in the axial direction. This means that bearing plane LE and connecting-rod plane P coincide in one plane. Consequently, the bearing distance LA between A bearing 360 and connecting-rod bearing 160 is equal to zero. The result of this is that connecting-rod force FP introduced from a connecting rod 140 (not shown in further detail here) via the connecting-rod bearing 160 to the connecting-rod-receiving portion 320 of the drive shaft 220 is transmitted directly, in particular free of bending moment, to the A bearing 360 and thus via the journal 450 into the wall of the housing 440.

FIG. 3B illustrates a bearing arrangement according to a further development of the invention. In this, the connecting-rod bearing 160 is arranged on the connecting-rod-receiving portion 320 and the A bearing 360 is arranged in the A-bearing-receiving portion 380 in such a way that there is an offset in the axial direction between connecting-rod bearing 160 and A bearing 360. Consequently, connecting-rod plane P of the connecting-rod bearing 160 and bearing plane LE of the A bearing 360 are situated apart and parallel to one another in the axial direction at a bearing distance LA. The result of this in particular is that a bending moment which is caused by the connecting-rod forces and which is formed from the connecting-rod force FP and a lever arm with the length LA acts on the connecting-rod receiving portion 320 of the drive shaft 220. Such a bearing arrangement can be used in an advantageous manner to compensate for a deformation of the journal 450 caused by a bending moment by a deformation of the drive shaft 220 caused in a targeted manner by means of the bearing distance LA. The bending moment acting here on the journal 450 results from the bearing force acting on the A bearing 360 and from the journal lever AH. This relationship is explained in more detail below in FIG. 4.

FIG. 3C illustrates by way of example a bearing arrangement according to a further development of the invention. In this development, what is concerned is a compressor having two cylinders 170, 171 (not shown here) and correspondingly two connecting rods 140, 141 (not shown here either). In the present case, the corresponding connecting-rod bearings 160, 161 are arranged next to one another on the connecting-rod-receiving portion 320. For this purpose, the A bearing 360 is arranged within the A-bearing-receiving portion 180 and on the journal 450 in such a way that the bearing plane LE lies in the axial direction centrally between the connecting-rod planes P1, P2. As already described in conjunction with FIG. 1, the central arrangement of the A bearing 360 in the axial direction between the connecting-rod bearings 160, 161 represents a compromise in order to minimize the bending moments caused by connecting-rod forces FP1, FP2 since, as a result of the arrangement of the connecting-rod planes P1 and P2 outside the bearing plane LG, a completely bending-moment-free mounting of the drive shaft 220 is not possible. In the present case, the first connecting-rod bearing 160 is arranged so as to be displaced by a first bearing spacing LA1 in the negative axial direction, that is to say in the direction of the wall of the housing 440 to which the journal 450 is fastened. Furthermore, the second connecting-rod bearing 161 is arranged by a second bearing distance LA2, which in the present case is equal in magnitude to the first bearing distance LA1, in the positive axial direction, that is to say in the direction of the free end face of the journal 450.

FIG. 3D illustrates a bearing arrangement according to a still further development of the invention. Here, by contrast with the development illustrated in FIG. 2C, the A bearing 360 is arranged with respect to the connecting-rod bearings 160, 161 in such a way that the bearing distances LA1 and LA2 each differ in size. It is possible therefrom, in the case of connecting rods 140, 141 which are loaded approximately equally in terms of magnitude, that a resulting overall connecting-rod force channeled from both connecting rods 140, 141 and thus both connecting-rod bearings 160, 161 into the drive shaft 220 acts substantially not within the bearing plane E. In an analogous manner to the bearing arrangement described in FIG. 3B, the thus occurring deformation caused in a targeted manner can be used to compensate for the deformation of the journal 450.

Alternatively, furthermore, it is possible, for the case that one connecting rod is more strongly loaded than the other connecting rod, that a bearing arrangement shown in FIG. 3D can be used in a targeted manner to take account of and compensate for this circumstance. In the present case, it is assumed for example that the connecting-rod force FP2 acting on the second connecting-rod bearing 161 is greater than the connecting-rod force FP1 acting on the first connecting-rod bearing 160. The axial position of the A bearing 360 is therefore displaced in the direction of the more strongly loaded connecting-rod bearing, in this case the connecting-rod bearing 161, with the result that the second bearing distance LA2 is smaller than the first bearing distance LA1. It is thereby ensured that the greater connecting-rod force FP2 acting on the connecting-rod bearing 161 acts on the drive shaft 220 in a connecting-rod plane P2 which in particular is situated so close to the bearing plane LE that the resulting bending moments does not cause a critical deformation of the drive shaft 220. What is meant by critical deformation in this context is a deformation which leads directly or indirectly to one or more of the disadvantages mentioned at the outset, in particular with regard to noise and vibration generation and wear behavior.

Figure 4:
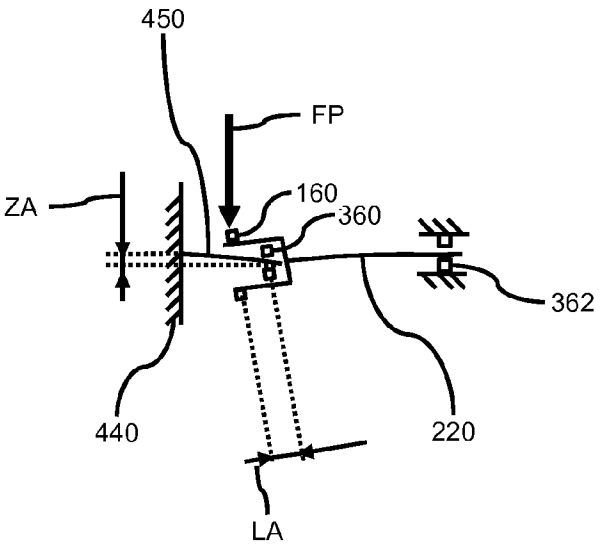
FIG. 4 shows a schematic illustration of a flexing of drive shaft and journal.

FIG. 4 is a schematic illustration showing a flexing of a drive shaft 220 and of a journal 450. This highly simplified illustration shows the deformations in an exaggerated manner. A connecting-rod force FP which acts on the connecting-rod bearing 160 is transmitted to the drive shaft 220 and thus to the A bearing 360. This force is finally channeled via the A bearing 360 into the journal 450, where, on account of the distance between housing 440 and A bearing 360, it leads to a bending moment which in turn results in a deformation of the journal 450, namely a journal deflection ZA. At the same time, the arrangement of A bearing 360 and connecting-rod bearing 160, in particular the arrangement of A bearing 360 and connecting-rod bearing 160 at an axial bearing distance LA, results in a situation in which a bending moment acts on the drive shaft 220. This bending moment is directly counter to the bending moment acting on the journal. It is thereby ensured in an advantageous manner that the drive shaft 220 is deformed in such a way that smallest possible forces, in particular transverse forces and tilting moments, act on the B bearing 362. The deformation of the drive shaft 220 thus partially or completely compensates for the journal deflection ZA.

Figure 5:
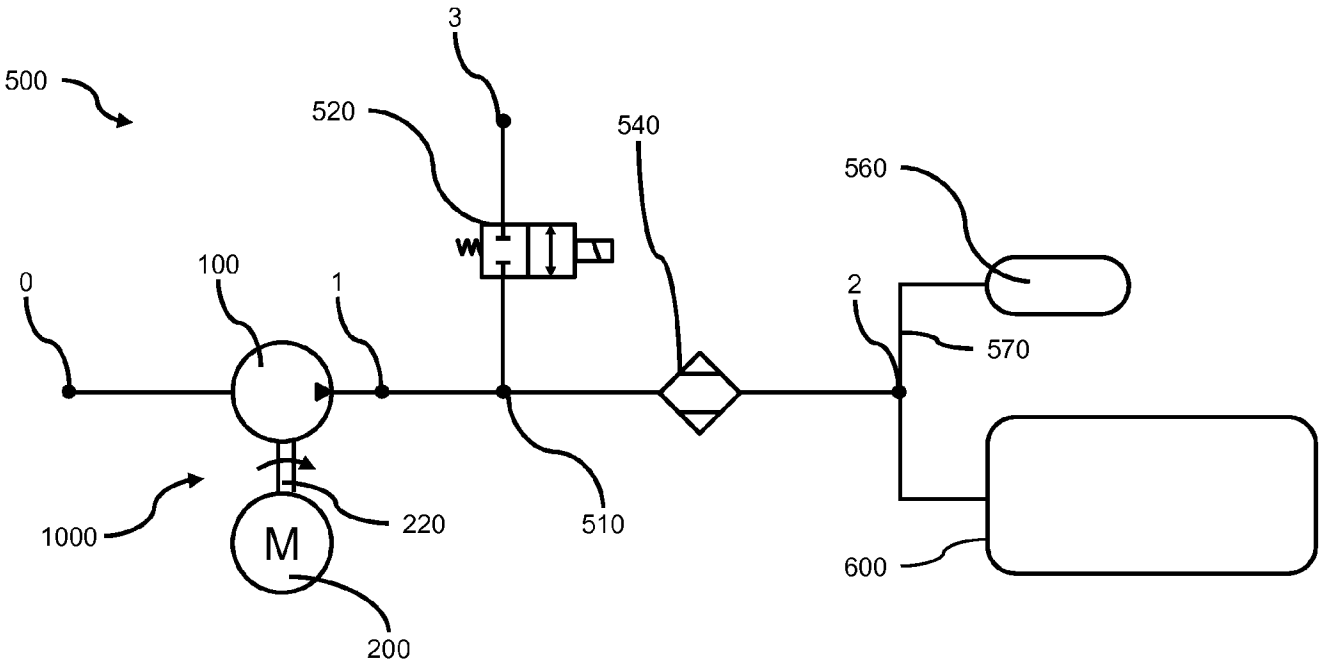
FIG. 5 shows a highly simplified, schematic overview of a compressed-air supply system.

FIG. 5 shows a highly simplified, schematic overview of a compressed-air supply system 500 having a compressor assembly 1000 for supplying a pneumatic system 600. The compressed-air supply system 500 has an air intake 0 for sucking in fresh air, said intake furthermore being connected to an inlet of the compressor 100 in a fluid-conducting, in particular gas-conducting, manner. The compressor 100 is driven as part of the compressor assembly 1000 by a drive 200 via a drive shaft 220. The compressed fresh air is furthermore provided via a compressed-air source 1 to which a branch 510 is connected. On the one hand, a vent 3 is connected via a venting valve 520 to this branch 510. On the other hand, an air dryer 540 is connected to the branch 510 and furthermore leads to a compressed-air connection 2. To this there are furthermore connected a compressed-air store 560 and the pneumatic system 600 via a gallery 570. The pneumatic system 600 can be for example an air spring system, or a further pneumatic system, in particular of a vehicle. Furthermore, individual valves, throttles and similar actuating means and also individual components, in particular of the pneumatic system, are not represented in this illustration for reasons of clarity and simplification.

Figure 6:
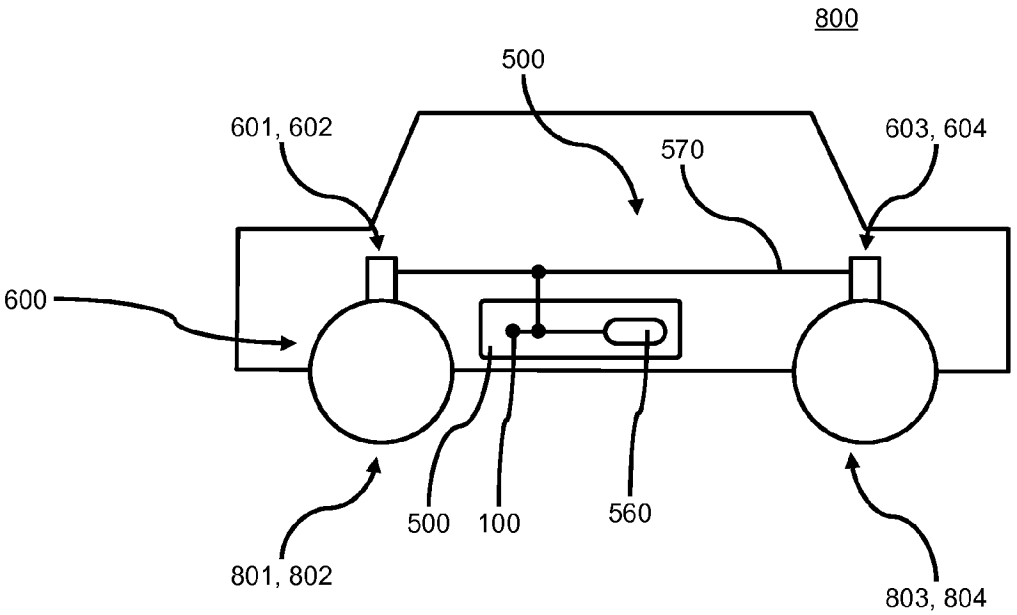
FIG. 6 shows a schematic illustration of a vehicle having a compressed-air supply system.

FIG. 6 shows a schematic illustration of a vehicle 800—in the present case in the form of a passenger car—having a compressed-air supply system 500 and a pneumatic system 600. In the case of vehicles in the passenger car sector, a low-noise and low-vibration operation is of large importance, since here, by contrast with applications in the truck sector, the acoustic requirements are higher or more sensitive. The passenger car vehicle 800 illustrated by way of example here for this reason, without restriction of the applicability also to trucks or other commercial vehicles, has four wheels 801, 802, 803 and 804, of which here the two respective front wheels are shown on account of the sectional illustration. Analogously to the number of wheels, the pneumatic system 600 has four air springs 601, 602, 603 and 604, of which here, analogously to the wheels, the two respective front air springs are shown on account of the sectional illustration. The air springs 601, 602, 603 and 604, which are respectively assigned to the wheels 801, 802, 803 and 804, are supplied by the compressed-air supply system 500 with compressed air as part of the pneumatic system 600. The compressed-air supply system 500 is connected in a fluid-conducting manner via the gallery 570 to the components of the pneumatic system 600, in this case the air springs 601, 602, 603 and 604 illustrated here.

The compressed-air supply system 500 is shown in highly simplified form in this illustration, with the result that only the compressed-air store 560 and the compressor 100 are visible. However, in a modification (not shown here), the compressor 100 could, additionally or alternatively, be used independently of the compressed-air supply system. The concept preferably offers the basis for an in particular low-vibration and low-noise compressor assembly which functions in an improved manner. Furthermore, a reduction of forces and/or moments and in particular a reduction of the dynamic loads and vibrations associated with the forces and/or moments lead to a more gentle mode of operation which have a positive effect on efficiency and durability of the compressor assembly.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE CHARACTERS

0 Air intake
1 Compressed-air source
2 Compressed-air connection
3 Vent
100 Compressor
140 First connecting rod
141 Second connecting rod
150 First compressor piston
151 Second compressor piston
160 First connecting-rod bearing
161 Second connecting-rod bearing
170 First cylinder
171 Second cylinder
164 Tolerance ring
200 Drive
220 Drive shaft
290 Electric motor
320 Connecting-rod-receiving portion
360 First bearing, connecting-rod-side drive shaft bearing (A bearing)
362 Second bearing, connecting-rod-remote drive shaft bearing (B bearing)
370 Cavity
380 First bearing-receiving portion (A bearing)
382 Second bearing-receiving portion (B bearing)
440 Housing
450 Journal
500 Compressed-air supply system
510 Branch
520 Venting valve
540 Air dryer
560 Compressed-air store
600 Pneumatic system
601, 602, 603, 604 Air spring
800 Vehicle
801, 802, 803, 804 Wheel
1000 Compressor assembly
A Axis of rotation of the drive shaft
AD Journal diameter
AH Journal lever
Ex Eccentric axis
FP Connecting-rod force
FP1 First connecting-rod force
FP2 Second connecting-rod force
H Stroke travel of the compressor piston
LA Bearing distance
LA1 First bearing distance
LA2 Second bearing distance
M Center plane, axial center plane of the A bearing
P1 First connecting-rod plane
P2 Second connecting-rod plane
PF Connecting-rod-remote end of the drive shaft
PS Connecting-rod-side end of the drive shaft
WA Shaft deflection, deflection of the drive shaft
ZA Journal deflection, deflection of the journal
BA Drive shaft bearing width
BP Connecting-rod bearing width
DAA Drive shaft bearing outside diameter
DIA Drive shaft bearing inside diameter
DAP Connecting-rod bearing outside diameter
DIP Connecting-rod bearing inside diameter
E Bearing plane
EA Axial center plane of the drive shaft bearing
EP Axial center plane of the connecting-rod bearing
UD Simple overlap
UD' Predominant overlap
UD" Complete overlap

The invention claimed is:

1. A compressor assembly for a compressed air feed of a compressed air supply system, for operating a pneumatic system, the compressor assembly comprising:

a connecting rod bearing defining an enclosed inner central void;

a compressor having a connecting rod in a connecting rod plane, wherein the connecting rod includes a compressor piston configured to reciprocate in a cylinder;

a drive having an axis of rotation, a drive shaft, and a housing, wherein the drive shaft is mounted in a drive shaft bearing and has a connecting rod side end and a connecting rod remote end, the drive shaft bearing rotatably mounting the drive shaft to the housing, wherein the drive shaft has a connecting-rod receiving portion which is arranged eccentrically to the axis of rotation of the drive at the connecting rod side end, the connecting rod bearing rotatably mounting the connecting rod to the connecting rod side end of the drive shaft, wherein at least a portion of the drive shaft bearing projects into the enclosed inner central void defined by the connecting rod bearing.

2. The compressor assembly as claimed in claim 1, wherein the drive shaft bearing is a connecting rod side drive shaft bearing, which is arranged at the connecting rod side end of the drive shaft in a bearing plane, the connecting-rod-side drive shaft bearing being a first bearing in a first bearing receiving portion arranged coaxially to the axis of rotation.

3. The compressor assembly as claimed in claim 2, wherein the drive shaft is further mounted in a connecting rod remote drive shaft bearing, which is arranged at the connecting rod remote end of the drive shaft, the connecting-rod-remote drive shaft bearing being a second bearing on a second bearing receiving portion arranged coaxially to the axis of rotation at the connecting rod remote end.

4. The compressor assembly as claimed in claim 3, wherein the first and second bearings are arranged within and/or on the housing.

5. The compressor assembly as claimed in claim 3, wherein the connecting rod bearing is formed as a rolling bearing, a needle bearing, a cylinder roller bearing, or a barrel bearing, and/or the first bearing and/or the second bearing are/is formed as a sliding bearing.

6. The compressor assembly as claimed in in claim 2, wherein the housing includes a journal, the first bearing receiving portion for receiving the first bearing is designed as a cylindrical cavity, and the first bearing is fastened on the journal which extends from the housing in a frame fixed manner and which is arranged practically coaxially to the axis of rotation, wherein the first bearing is seated in the cylindrical cavity.

7. The compressor assembly as claimed in claim 6, wherein the first bearing is seated fixedly on the journal and firmly seated in the first bearing receiving portion and connects the journal and the first bearing receiving portion such that they can be rotated relative to one another.

8. The compressor assembly as claimed in claim 2, wherein the connecting rod is arranged in the bearing plane of the first bearing.

9. The compressor assembly as claimed in claim 2, wherein the connecting rod is arranged at an axial bearing distance from the first bearing.

10. The compressor assembly as claimed in claim 1, wherein the compressor has a plurality of connecting rods.

11. The compressor assembly as claimed in claim 10, wherein the connecting rod is a first connecting rod and the compressor assembly comprises a second connecting rod, the first connecting rod and the second connecting rod are arranged in such a way that the first connecting rod is arranged at a first bearing distance and the second connecting rod is arranged at a second bearing distance in the direction of the axis of rotation, from the bearing plane.

12. The compressor assembly as claimed in claim 11, wherein the first and the second connecting rods are arranged such that the bearing plane is situated in the axial direction centrally between a first connecting rod plane and a second connecting rod plane.

13. The compressor assembly as claimed in claim 1, wherein the connecting rod and the compressor piston are rigidly connected to one another, wherein the compressor is a wobble piston compressor.

14. The compressor assembly as claimed in claim 1, wherein the compressor is a single stage compressor or a multistage compressor.

15. A compressed air supply system for operating a pneumatic system, having:

the compressor assembly as claimed in claim 1, an air dryer, and a valve arrangement.

16. A vehicle having a pneumatic system, the pneumatic system including the compressor assembly as claimed in claim 1.

17. The compressor assembly as claimed in claim 1, wherein the drive shaft bearing defines a first rotational plane orthogonal to the drive shaft and the connecting rod bearing defines a second rotational plane orthogonal to the drive shaft; the housing including a journal axially projecting into the drive shaft, the drive shaft bearing rotatably mounting the drive shaft to the journal, and both the first and second rotational planes intersecting the journal.

18. The compressor assembly as claimed in claim 1, wherein the connecting-rod receiving portion is static with respect to the drive shaft such that the connecting-rod receiving portion and the drive shaft rotate at the same speed about the axis of rotation of the drive.

19. The compressor assembly as claimed in claim 18, wherein the connecting-rod receiving portion defines a blind inner void in which the drive shaft bearing is disposed, wherein the blind inner void and the inner central void at least partially overlap.

20. The compressor assembly as claimed in claim 1, wherein the compressor piston is configured to linearly reciprocate in the cylinder, the cylinder being a cylindrical void defined by the housing.

* * * * *